United States Patent [19]

Leonard, Jr.

[11] 3,936,037

[45] Feb. 3, 1976

[54] VENTED GRAVITY BLENDER

[75] Inventor: James H. Leonard, Jr., Houston, Tex.

[73] Assignee: Allied Industries, Inc., Houston, Tex.

[22] Filed: May 22, 1974

[21] Appl. No.: 472,510

[52] U.S. Cl. ..... 259/180; 259/4 R; 259/95

[51] Int. Cl.[2] ..... B01F 5/00

[58] Field of Search ..... 259/4, 18, 36, 95, 180

[56] References Cited

UNITED STATES PATENTS

| | | | |
|---|---|---|---|
| 3,216,629 | 11/1965 | Goins | 259/180 X |
| 3,268,215 | 8/1966 | Burton | 259/180 |
| 3,351,326 | 11/1967 | Alberts et al. | 259/95 |
| 3,456,922 | 7/1969 | Goins | 259/180 X |

*Primary Examiner*—Harvey C. Hornsby
*Assistant Examiner*—James A. Niegowski
*Attorney, Agent, or Firm*—Kenway & Jenney

[57] ABSTRACT

A gravity blender that discharges particulate material into a pressurized conveying system is provided with a conduit to substantially alleviate differential pressures between the blend chamber and the interior of the blender supply bin.

2 Claims, 7 Drawing Figures

VENTED GRAVITY BLENDER

BACKGROUND OF THE INVENTION

This invention relates generally to gravity blenders and more particularly to improvements for gravity blenders which are connected to pressurized discharge systems.

In the past, it has been known to connect a gravity blender with a pressurized discharge system such as a fluid current conveyor. Fluid current conveyors quickly and efficiently move blended particulate material from the blender, where the material may be stored, to other areas of a plant for use or other processing.

Typically, the gravity blender includes an elongated bin having several conduits therein that convey particulate material downwardly from selected regions of the bin under the influence of gravity. These conduits normally discharge particulate material into a blending zone where the material is intermixed.

In applications where the blending zone empties particulate material into a pressurized discharge system, a pressure differential often occurs between the interior of the bin and the blending zone. Such pressure differentials are undesirable since they may cause pressure-induced holdup of the particulate material. The holdup results from a resistance to downward gravity-induced movement of particulate material which is generated by a high pressure from below that is opposed by a lower pressure from above.

In gravity blender applications where the discharge zone does not empty into a pressurized discharge system, a pressure-induced material holdup can also result simply from the displacement of particulate material from a closed bin. As particulate material leaves the bin the volume available to air trapped therein increases and causes a sub-atmospheric internal pressure. Thus material flowing by gravity from a closed bin to atmospheric pressure again may be resisted by a pressure differential.

The pressure-induced product holdup leads to intermittent or unsteady flow from the blender which makes volumetric flow rates from the blender difficult to accurately predict and control.

Further, with many finely divided particulate materials that are gravity blended and discharged to atmospheric systems, undesirable quantities of dust may escape causing both waste and pollution.

As a consequence, it would be desirable to have a gravity blender substantially free from the above undesirable characteristics. It is to be noted however, that indiscriminate positioning of apparatus within a gravity blender may result in substantially adverse effects on the operation thereof. Accordingly, this invention relates to a method and apparatus for solving the problems in a direct and efficient manner.

OBJECTS AND BRIEF SUMMARY OF THE INVENTION

A general object of this invention is to provide a novel gravity blender which substantially minimizes or reduces problems of the type mentioned above.

It is a particular object to provide a novel gravity blender having apparatus which eliminates pressure-induced product holdup in gravity blenders connected to a pressurized discharge system.

It is another object of this invention to provide a novel gravity blender in which pressure-induced flow irregularities are substantially reduced.

Still another object of this invention is to provide a gravity blender in which dust from the particulate material is recycled to the gravity blender bin by entrainment with pressure differential induced air flow.

Yet another object is to provide a novel gravity blender in which pressure-induced material holdup is eliminated with apparatus that may be readily and inexpensively incorporated in a gravity blender without major structural modifications.

Yet still another object is to provide a novel gravity blender wherein the volumetric rate of discharge is capable of consistently accurate determination.

These and many other objects will become apparent to those skilled in the art when the appended claims are considered in light of the detailed description and the drawings.

At least some of the foregoing objects are accomplished by a gravity blender comprising a bin and a pressurized discharge chamber having at least one hollow conduit to connect the blend chamber and the top of the bin for relief of pressure differences therebetween.

BRIEF DESCRIPTION OF THE DRAWINGS

Although the specification concludes with claims which particularly point out and distinctly claim the subject described in the following detailed description which may be best understood when read in connection with the accompanying drawings in which:

DETAILED DESCRIPTION OF THE INVENTION

Figure 1:
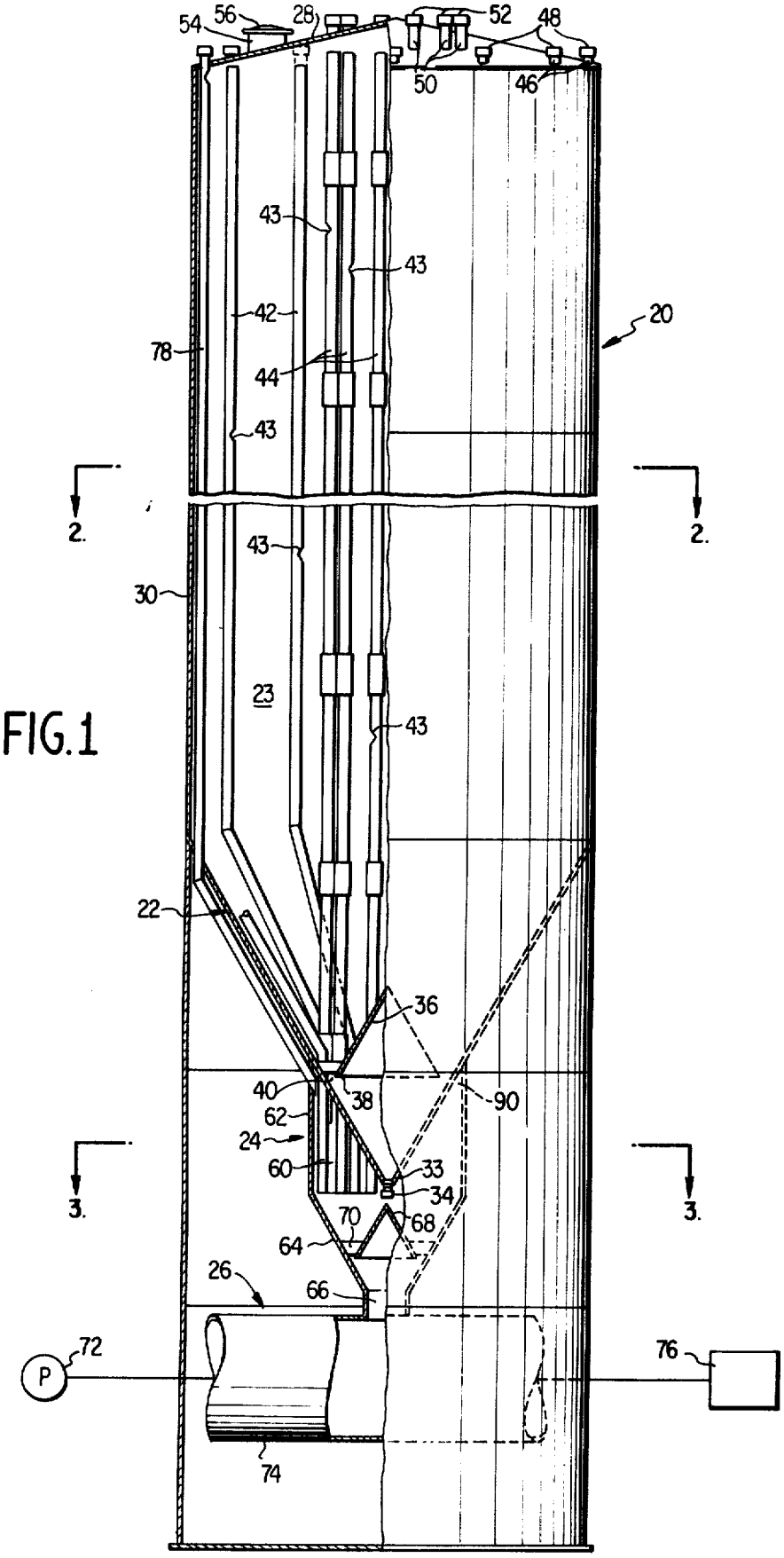
FIG. 1 is an elevational view in partial section of a gravity blender incorporating the instant invention.

In FIG. 1, a gravity blender 20 is depicted as including a generally vertical bin, or container, 22 which discharges particulate material into a discharge zone, or blend chamber, 24 that is located vertically below the bin 22. The discharge zone 24 in turn is connected to a pressurized discharge system 26 which conveys blended particulate material for further use or processing.

The bin 22 may be provided with a generally conical top 28 which is securely attached to a circularly cylindrical wall 30 having a generally vertical orientation. Attached to the bottom of the cylindrical wall 30 is a generally conical bottom 32. The vertex of the conical bottom 32 is provided with a central opening 34 from which some particulate material may be removed from the bin 22.

The bin 22 defines a bin chamber 23 which includes an inverted chamber cone 36 for directing particulate material while flowing downwardly from the bin 22 under the influence of gravity. The chamber cone 36 includes a bottom edge 38 and is coaxially positioned with respect to the conical bottom 32 of the bin 22. The bottom edge 38 of the chamber cone 36 and the sloping internal wall of the conical bottom 32 define an annular space 40 therebetween.

Disposed within the bin chamber 23 are a plurality of peripheral downcomers 42 and a plurality of central downcomers 44. Each of the downcomers 42, 44 is provided with at least one lateral opening 43 in the bin chamber 23 which admits particulate material from the bin chamber 23 and to convey it downwardly to the discharge zone 24. The lateral openings 43 of the downcomers 42, 44 are positioned such that particulate material is withdrawn from selected vertical and radial regions of the bin chamber 23.

Figure 2:
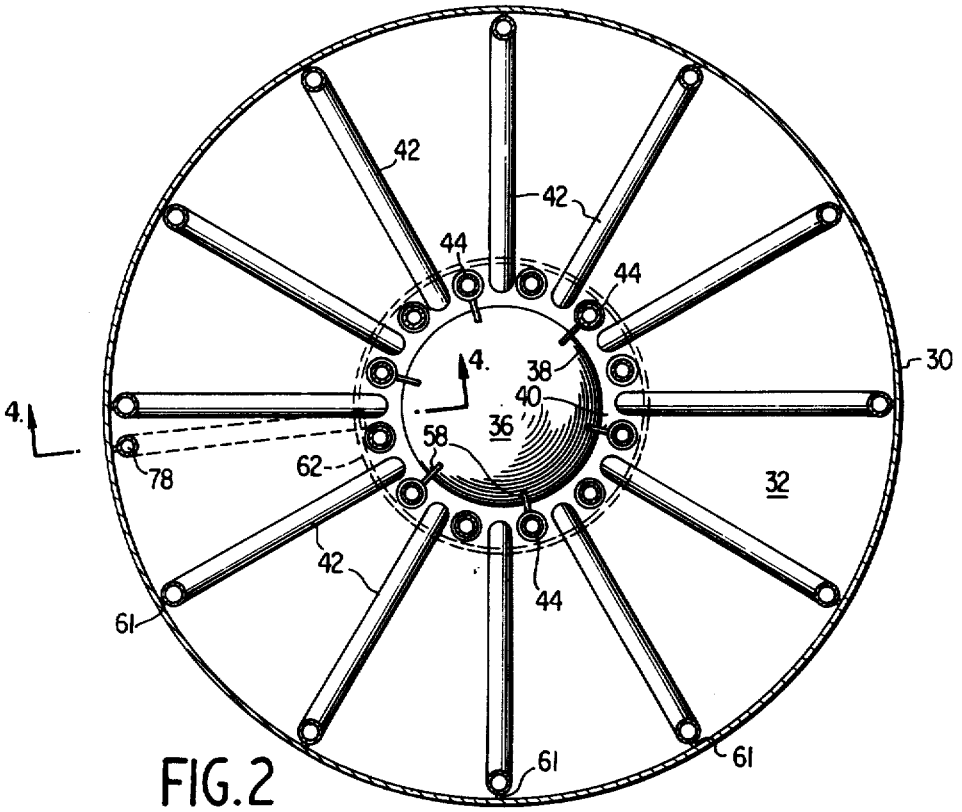
FIG. 2 is a cross sectional view taken along line 2—2 of FIG. 1.

The peripheral downcomers 42 are generally equiangularly spaced around the periphery of the cylindrical wall 30 of bin 22 as may be clearly seen from FIG. 2. Returning to FIG. 1, the top end 46 of each peripheral downcomer 42 may be provided with a cap 48 threadably connected thereto in airtight relationship. Similarly, the top end 50 of each of the central downcomers 44 may be provided with a cap 52 threadably connected thereto in airtight relationship. As most clearly seen from FIG. 1, the top end 46 of each of the peripheral downcomers 42 and the top end 50 of each of the central downcomers 44 projects through the conical top 28 of the bin 22. By permitting the downcomers 42, 44 to project through the conical top 28, the downcomers may be both positioned and supported at their top end by the conical top 28.

The conical top 28 also includes a filler opening 54 through which the bin chamber 23 may be filled with particulate material. The filler opening 54 is provided with a cap 56 which may be secured thereto in airtight relationship.

Toward the bottom end of the central downcomers 44 a plurality of generally radial chamber cone supports 58 may be provided to position the chamber cone 36 with respect to the gravity blender bin 22 (see FIG. 2). Alternately, the chamber cone 36 may be supported directly by members that are attached to the interior of conical bottom 32.

Figure 3:
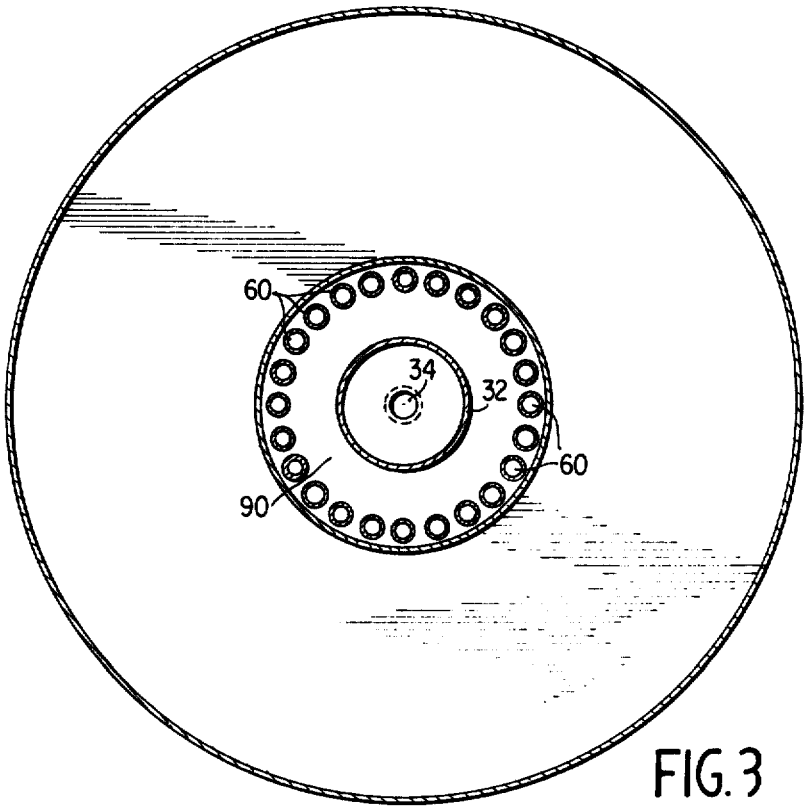
FIG. 3 is a cross sectional view taken along line 3—3 of FIG. 1.

The peripheral downcomers 42 and the central downcomers 44 are arranged within the chamber 23 such that their lower ends are interdigitated (see FIG. 2) and are positioned generally equiangularly within the annular space 40 to permit a generally uniform, but minimal, obstruction to the flow of particulate material through the annular space 40. The lower end 60 of each of the downcomers 42, 44 projects through the conical bottom 32 of the bin and extends into the discharge zone 24 (see FIG. 1 and 3). Accordingly, the central downcomers 44 are primarily positioned and retained in the chamber 23 by their connections with the conical top 28 and the conical bottom 32 of the bin 22. The peripheral downcomers 42, likewise may be positioned and retained by their respective connections to the conical top 28 and the conical bottom 32, but may also be provided with additional supports 61 that are attached to the inside of cylindrical wall 30 (see FIG. 2).

Returning to FIG. 1, the discharge zone 24 is defined partially by a generally cylindrical wall 62 which depends downwardly from the conical bottom 32 of the bin and partially by a frustoconical bottom 64 which is attached to the bottom of cylindrical wall 62. The frustoconical bottom includes a discharge opening 66 at the lowermost end thereof. Coaxially disposed within the frustoconical bottom 64 is an inverted cone 68 which is supported relative to the frustoconical bottom 64 by a plurality of generally radially disposed cone supports 70. The apex of cone 68 is disposed adjacent the bottom opening 34 of bin 22 to uniformly spread particulate material flowing therethrough.

The discharge opening 66 may be connected to the pressurized discharge system 26 such as a fluid current conveyor which may comprise, for example, a pump 72 to supply a pressurized fluid current to a conduit 74 with which the discharge opening 66 communicates. The pressurized fluid current flowing through the conduit 74 is suitable to convey blended particulate material from the discharge opening 66 to subsequent processing or use at a remote area schematically illustrated as 76.

The pressurized fluid in conduit 74 creates an internal pressure in the blend chamber 24 that exceeds the internal pressure of bin 22. In some applications, the blend chamber 24 may be pressurized directly by connection to pressurized processing apparatus. Where the blend chamber has a pressure which exceeds the pressure of the bin chamber 23, a pressure differential force results which opposes gravity movement of particulate material from the bin chamber 23 through the downcomers 42, 44 and the bottom opening 34 into the blend chamber 24.

Figure 4:
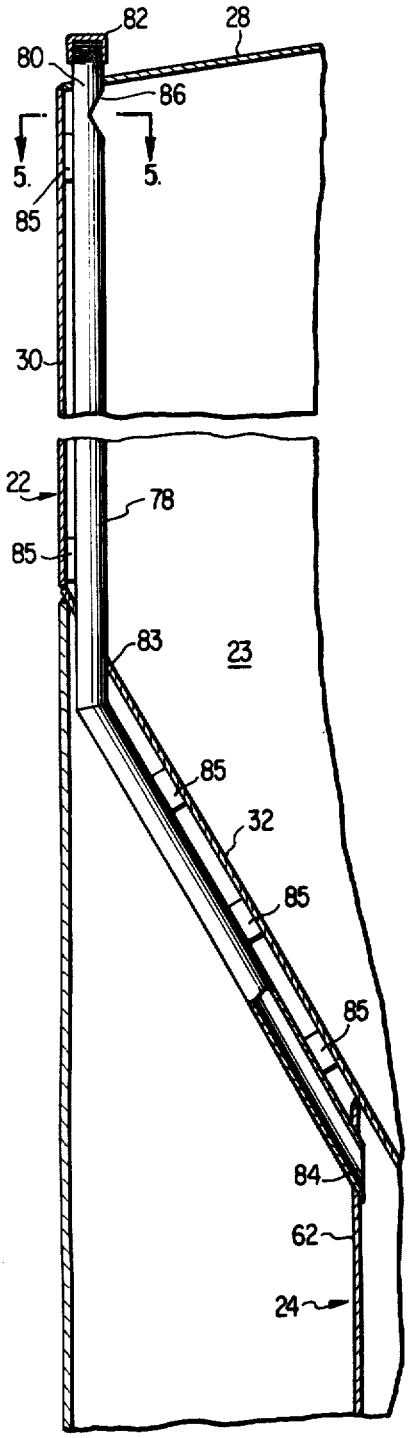
FIG. 4 is a partial cross sectional view taken along line 4—4 of FIG. 2.

In accordance with the subject invention, this pressure differential force is obviated by pressure equalization means comprising a conduit 78 as best illustrated in FIG. 4. Among other alternatives, a hollow member such as a vent tube might also be used.

The conduit 78 is connected to both the chamber 23 of bin 22 and the discharge zone 24. The top end of the conduit 78 projects through the conical top 28 of bin 22 and is provided with a threadably secured cap 82 which makes a preferably airtight connection. The bottom end 84 of the conduit 78 is open and projects through the cylindrical wall 62 of the discharge zone 24. The conduit 78 passes through the generally conical bottom 32 of bin 22 intermediate the ends of the conduit.

Figure 7:
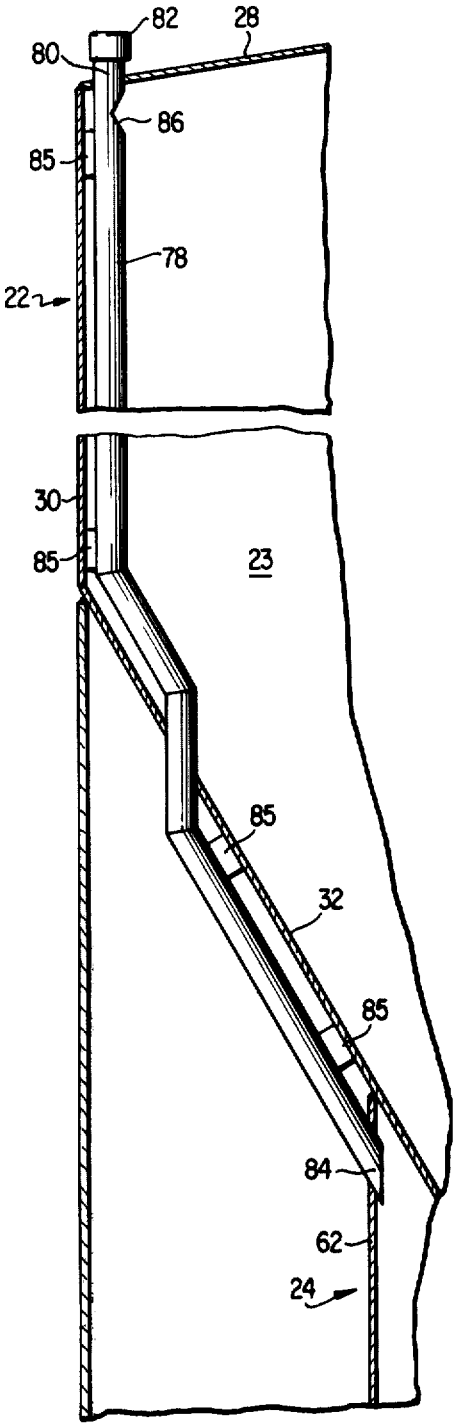
FIG. 7 is a slightly modified illustration similar to FIG. 4.

In the embodiment illustrated in FIG. 4, the conduit 78 passes through the conical bottom 32 at an opening 83 provided therefor adjacent to the cylindrical wall 30 of the bin 22. This construction is preferable in applications where it is highly desirable to provide the least obstruction to the flow of particulate material within the blend chamber 23. Where the movement of particulate material is not so critical, the conduit 78 may pass through the conical wall 32 at a point positioned closer to the discharge zone 24 according to an alternate embodiment of the invention as illustrated in FIG. 7.

Figure 5:
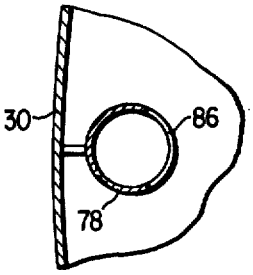
FIG. 5 is a cross sectional view taken along line 5—5 of FIG. 4.
Figure 6:
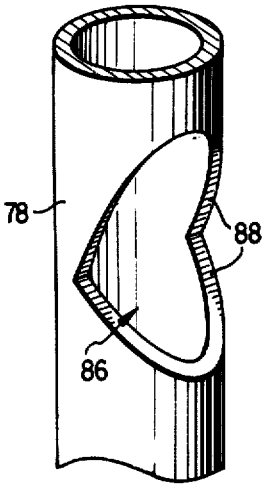
FIG. 6 is a pictorial representation of the vent opening of the present invention.

To provide communication between the top of the bin chamber 23 and the discharge zone 24, the conduit 78 includes a notched opening 86 as illustrated in FIG. 4. From FIG. 5 it will be apparent that the notch 86 does not completely sever the conduit 78 although it does provide fluid communication between the interior of the conduit 78 and the bin 23. In FIG. 6, the shape of the opening is illustrated isometrically as being formed by two intersecting planes 88 which cut through the cylindrical wall of the conduit 78.

The conduit 78 may be attached to the cylindrical wall 30 of the bin 22 and to the conical bottom 32 by means of a plurality of supports 85. The supports 85 give a secure and rigid connection which may easily be made. Where the conduit 78 is fabricated from a pipe, it is apparent that an inexpensive means of rendering pressure differential forces ineffective may be obtained which is easily adapted to existing gravity blenders.

In operation, the bin chamber 23 is filled with particulate material through the filler opening 54 in the conical top 28 of the bin 22. The particulate materials is collected into a plurality of discrete streams in the downcomers 42, 44 through the openings therein. The streams are conveyed downwardly under the influence of gravity through the peripherally disposed downcomers 42 and the centrally disposed downcomers 44 through the spaced openings 43 provided therefor. A portion of the particulate material also passes downwardly under the influence of gravity through the annular space defined between the conical bottom 32 and the chamber cone 36. The particulate material is discharged into the blend chamber 24 from the lower ends 60 of the downcomers 42, 44 and from the bottom opening 34 of the conical bottom 32 of the bin 22. The blend chamber 24 is pressurized relative to the bin chamber 23 by connecting the blend chamber 24 to a pressurized discharge system 26 or from the expansion of air or gas within a closed bin chamber 23 to fill the space caused by gravity removal of particulate material.

The discharged particulate material is thereupon blended and intermixed while moving downwardly around the inverted cone 68 within the frustoconical portion 64 of the blend chamber 24. The blended particulate material is subsequently discharged from the discharge opening 66 into the pressurized discharge system 26. Alternatively, the blended particulate material could be discharged into a conveying system which operates at substantially atmospheric pressure.

While the particulate material moves from the bin chamber 23 to the discharge opening 66, the pressure differential forces opposing gravitational movement are relieved by venting the blend chamber 24 to the top of the bin chamber. The conduit 78 which communicates between the top of the blend chamber 90 and the top of the bin chamber 23 permits fluid communication therebetween that results in substantially similar internal pressures to minimize or eliminate the pressure differential forces.

Where the gravity blender bin 22 is not vented to the atmosphere and where the blender discharges to the atmosphere, a flow of air from the blend chamber 24 to the top of the chamber 23 will result from the discharge of particulate material. With particulate material that has fine, dust-like, components, the flow of air is useful to synergistically entrain a portion of the fine components and recycle them to the bin chamber 23 thereby reducing loss of material and atmospheric pollution.

SUMMARY OF MAJOR ADVANTAGES

It will now be apparent to those skilled in the art that the gravity blender according to this invention includes pressure equalization means which substantially eliminates pressure holdup of particulate materials discharged into a pressurized discharge system.

In addition, any gravity flow irregularities which might otherwise be present, are substantially reduced or eliminated as a result of the elimination of the pressure holdup.

Yet another advantage of this invention is a gravity blender which may be connected to a pressurized discharge system and still permit accurate volumetric flow rate determination.

Still another advantage of a gravity blender according to this invention is that the pressure equalization means presents a minimal obstruction to the conventional operation of a gravity blender.

Another feature of the gravity blender of this invention is that the vent means may be constructed from inexpensive materials and may be readily incorporated into existing gravity blenders without major structural modifications.

Thus it is apparent that there has been provided in accordance with the invention, a gravity blender that substantially satisfied the objects and advantages set forth above. Although the present invention has been described in conjunction with a specific embodiment thereof, it is evident that many alternatives, modifications, variations and equivalents will be apparent to those skilled in the art in light of the foregoing disclosure of the invention. Accordingly, it is expressly intended that all such alternatives, modifications, variations and equivalents which fall within the spirit and scope of the invention as defined by the appended claims be embraced thereby.

What is claimed is:

1. A gravity blender for particulate materials comprising:

a container for the particulate materials, said container having a container wall and a closed top;

a plurality of conduits disposed substantially within said container and operable to convey particulate materials downward under the influence of gravity, each of said conduits having one end projecting downwardly through said container wall and each of said conduits being provided with at least one lateral opening operable to receive particulate materials from said container;

a blending chamber operable to receive particulate material from said projecting one ends of said plurality of particulate material conveying conduits, with said projecting one ends of said plurality of particulate material conveying conduits projecting into a blending zone contained within the interior of said blending chamber and having material outlets operable to discharge particulate material thereinto, and said blending zone being pressurized;

a pressurized discharge opening disposed below, and in fluid communicating relation with, said blending zone;

pressurized conveying means connected to said discharge opening for receiving particulate material therefrom; said pressurized blending zone, pressurized discharge opening, and pressurized conveying means being in mutual, fluid communicating relation;

said pressurized conveying means being operable to convey particulate material away from said pressurized discharge opening and transmit pressurized, particulate material conveying fluid therethrough operable to pressurize said pressurized discharge opening and said pressurized blending zone; and pressure equalization means for relieving pressure differences between said blending zone and said container which oppose gravity movement of particulate materials through said plurality of particulate material conveying conduits;

said pressure equalization means being separate from and operationally independent of said plurality of particulate material conveying conduits and including first opening means, separate from and independent of said plurality of particulate material conveying conduits, and communicating with a cavity located adjacent said closed top of said container and above a body of particulate material contained within said container, with downward movement of said body of particulate material, through said plurality of particulate material conveying conduits being operable, but for the operation of said pressure equalization means, to reduce the pressure of fluid in said cavity, second opening means, separate from and independent of said plurality of particulate material conveying conduits, and communicating with said blending zone above said outlets of said first ends of said plurality of particulate material conveying conduits, and pressure equalizing conduit means, separate from and independent of said plurality of particulate material conveying conduits, and providing continuous pressure equalizing communication between said first and second opening means with said continuous pressure equalizing communication being operable to release pressure differences between said blending zone and said cavity located above said body of particulate material.

2. A method of gravity blending particulate materials, said method comprising:

providing a container for particulate materials, said container having a container wall and a closed top;

providing a plurality of conduits disposed substantially within said container and operable to convey particulate materials downward under the influence of gravity, with each of said conduits having one end projecting downwardly through said container wall and each of said conduits being provided with at least one lateral opening operable to receive particulate materials from said container;

providing a blending chamber operable to receive particulate material from said projecting one ends of said plurality of particulate material conveying conduits, with said projecting one ends of said plurality of particulate material conveying conduits projecting into a blending zone contained within the interior of said blending chamber and having material outlets operable to discharge particulate material thereinto, and said blending zone being pressurized;

providing a pressurized discharge opening disposed below, and in fluid communicating relation with, said blending zone;

providing pressurized conveying means connected to said discharge opening for receiving particulate material therefrom;

maintaining said pressurized blending zone, pressurized discharge opening, and pressurized conveying means being in mutual, fluid communicating relation; causing said pressurized conveying means to convey particulate material away from said pressurized discharge opening and transmit pressurized, particulate material conveying fluid therethrough operable to pressurize said pressurized discharge opening and said pressurized blending zone; and providing pressure equalization means for relieving pressure differences between said blending zone and said container which oppose gravity movement of particulate materials through said plurality of particulate material conveying conduits;

maintaining said pressure equalization means separate from and operationally independent of said plurality of pariculate material conveying conduits and including therein first opening means, separate from and independent of said plurality of particulate material conveying conduits, and communicating with a cavity located adjacent said closed top of said container and above a body of particulate material contained within said container, with downward movement of said body of particulate material, through said plurality of particulate material conveying conduits being operable, but for the operation of said pressure equalization means, to reduce the pressure of fluid in said cavity, second opening means, separate from and independent of said plurality of particulate material conveying conduits, and communicating with said blending zone above said outlets of said first ends of said plurality of particulate material conveying conduits, and pressure equalizing conduit means, separate from and independent of said plurality of particulate material conveying conduits, and providing continuous pressure equalizing communication between said first and second opening means with said continuous pressure equalizing communication being operable to release pressure differences between said blending zone and said cavity located above said body of particulate material.

* * * * *